US011272749B2

(12) United States Patent
Wu et al.

(10) Patent No.: US 11,272,749 B2
(45) Date of Patent: Mar. 15, 2022

(54) WATERSEAL VIRUS-KILLING MASK

(71) Applicant: Wuyi University, Jiangmen (CN)

(72) Inventors: Min Wu, Jiangmen (CN); Guowei Jiang, Jiangmen (CN); Xinlin Li, Jiangmen (CN); Gongfa Chen, Jiangmen (CN); Guangwei Chen, Jiangmen (CN); Fangsen Cui, Jiangmen (CN)

(73) Assignee: Wuyi University, Jiangmen (CN)

( * ) Notice: Subject to any disclaimer, the term of this patent is extended or adjusted under 35 U.S.C. 154(b) by 154 days.

(21) Appl. No.: 16/840,889

(22) Filed: Apr. 6, 2020

(65) Prior Publication Data

US 2021/0259335 A1 Aug. 26, 2021

(30) Foreign Application Priority Data

Feb. 25, 2020 (CN) ..... 202010116220.6

(51) Int. Cl.
*A41D 13/11* (2006.01)
*A62B 23/02* (2006.01)

(52) U.S. Cl.
CPC ..... *A41D 13/1192* (2013.01); *A62B 23/025* (2013.01)

(58) Field of Classification Search
CPC ... A41D 13/11–1192; A62B 7/00; A62B 7/10; A62B 9/00; A62B 9/02; A62B 9/04; A62B 17/00; A62B 17/006; A62B 18/00; A62B 18/02; A62B 18/08; A62B 18/084; A62B 18/088–10; A62B 23/00–025
See application file for complete search history.

(56) References Cited

U.S. PATENT DOCUMENTS 4,224,939 A * 9/1980 Lang ..... A61M 16/08 128/204.28
2008/0295831 A1* 12/2008 Svehaug ..... A61M 11/02 128/203.15
2008/0314391 A1* 12/2008 Acharya ..... A61M 16/0666 128/207.18

* cited by examiner

*Primary Examiner* — Rachel T Sippel
(74) *Attorney, Agent, or Firm* — Vivacqua Crane PLLC

(57) ABSTRACT

Disclosed is a waterseal virus-killing mask, including a mask body, a liquid virus-killing assembly, and two elastic ear loops. A breather valve is disposed on an outer surface of the mask body. The two elastic ear loops are disposed on two sides of the mask body, respectively. The liquid virus-killing assembly includes a U-shaped tube within which disinfectant is provided. A disinfectant replenishing tube is vertically disposed at an upper end in the middle of the U-shaped tube. A first horizontal straight tube and a second horizontal straight tube are separately disposed at two ends of the U-shaped tube. A left end of the first horizontal straight tube is in communication with an opening of the breather valve. A first filter mesh used to separate water and air is disposed at a right end of the first horizontal straight tube.

9 Claims, 5 Drawing Sheets

WATERSEAL VIRUS-KILLING MASK

CROSS-REFERENCE TO RELATED APPLICATIONS

This application is based on and claims the benefit of priority from Chinese Patent Application No. 2020101162206, filed on 25 Feb. 2020, the entirety of which is incorporated by reference herein.

TECHNICAL FIELD

The disclosure relates to the field of health protection products, and in particular to a waterseal virus-killing mask.

BACKGROUND

Outbreaks of 2019 Novel Coronavirus Pneumonia (NCP), also referred to as COVID-19, have gain world's attention recently. Persons infected with this virus have symptoms of varying degrees. The infected persons will have a fever or slight cough, or will catch pneumonia, or even die. The novel pneumonia coronaviruses are mainly spread through breathery droplets. A mask can be worn to avoid breathing in the air that contains novel coronaviruses. Therefore, wearing a mask is an important method for preventing the infection of NCP. However, most existing masks filter out viruses in the air through filtering layers which cannot capture and kill the viruses, thus having a limited effect. Moreover, the virus blocking effect of such a mask keeps diminishing over time, so the mask needs to be changed after one or several times of use. Under the current epidemic situation, there is a severe shortage of masks.

SUMMARY

The disclosure is to at least resolve the foregoing technical problem in the prior art to some extent. For this, the disclosure provides a waterseal virus-killing mask. In the mask, disinfectant is provided in a U-shaped tube, so that novel pneumonia coronaviruses in the air flowing through the U-shaped tube are killed by the disinfectant, the disinfectant in the air is then filtered out by a first filter mesh, and the air is eventually inhaled by a human, thereby effectively protecting the physical health of a wearer. In addition, the mask has relatively long service life and can be repeatedly used, thereby resolving the problem that a large number of conventional disposable masks are used.

A waterseal virus-killing mask according to an embodiment of the disclosure includes: a mask body with a breather valve disposed on an outer surface of the mask body, two elastic ear loops disposed on two sides of the mask body, respectively, and a liquid virus-killing assembly. The mask includes a U-shaped tube within which disinfectant is provided, a disinfectant replenishing tube vertically disposed at an upper end in the middle of the U-shaped tube, a first horizontal straight tube disposed at one end of the U-shaped tube and including a left end in communication with a port of the breather valve and a right end within which a first filter mesh used to separate water and air is disposed, and a second horizontal straight tube disposed at the other end of the U-shaped tube.

The waterseal virus-killing mask according to the embodiment of the disclosure at least has the following technical effects. By disposing the liquid virus-killing assembly at the port of the breather valve, as a wearer inhales air, novel coronaviruses in external air entering the U-shaped tube through the second horizontal straight tube will be killed by the disinfectant when the external air flows through the U-shaped tube. The disinfected air then passes through the first filter mesh to have the disinfectant contained in the air filtered, so that the air eventually inhaled by the wearer is disinfected clean air without disinfectant, thereby effectively protecting the physical health of a wearer. As the wearer exhales air, the exhaled air enters the U-shaped tube through the first horizontal straight tube to be disinfected by the disinfectant, thereby ensuring that the exhaled air contains no virus. Particularly, when a person infected with NCP wears the mask, it can be ensured that air exhaled by the person contains no virus, thereby reducing the risk of cross infection. The embodiment of the disclosure can achieve effective virus-killing and adequate protection. The mask can be repeatedly used and has long service life, thereby resolving the problem that a large number of conventional disposable masks are used. Moreover, with the provision of the disinfectant replenishing tube, when the disinfectant in the U-shaped tube is reduced to a particular amount after a period time of use, the U-shaped tube can be replenished with the disinfectant through the disinfectant replenishing tube.

According to some embodiments of the disclosure, the U-shaped tube is a transparent tube provided with a scale for observing the remainder of the disinfectant.

According to some embodiments of the disclosure, an air inlet and outlet tube is disposed at the port of the breather valve, a first external thread is disposed at an end portion of the air inlet and outlet tube away from the breather valve, and a first internal thread matching the first external thread is disposed in a left end portion of the first horizontal straight tube.

According to some embodiments of the disclosure, a third straight tube is formed by bending outward a left end of the U-shaped tube bends outward by 90°, the first horizontal straight tube is detachably connected to the third straight tube, and the first filter mesh is disposed at a connection between the first horizontal straight tube and the third straight tube.

According to some embodiments of the disclosure, the first horizontal straight tube is provided, on an outer surface of the right end of the first horizontal straight tube, with a second external thread, and a second internal thread matching the second external thread is disposed in a left end portion of the third straight tube.

According to some embodiments of the disclosure, a right end portion of the first horizontal straight tube is inserted in a left end of the third straight tube, a sealing sleeve is sleeved over the right end portion of the first horizontal straight tube, and the sealing sleeve enables the first horizontal straight tube to be in interference fit in the third straight tube.

According to some embodiments of the disclosure, a second filter mesh used to separate water and air is disposed within a left end of the second horizontal straight tube.

According to some embodiments of the disclosure, a fourth straight tube is formed by bending outward a right end of the U-shaped tube bends outward by 90°, the left end of the second horizontal straight tube is threaded to a right end of the fourth straight tube, and the second filter mesh is disposed at a connection between the second horizontal straight tube and the fourth straight tube.

According to some embodiments of the disclosure, a filter sheet is disposed between the outer surface and an inner surface of the mask body, a positioning post is disposed on a right side of the inner surface of the mask body, and the filter sheet is connected to the positioning post.

Additional aspects and advantages of the disclosure will be partially appreciated and become apparent from the description below, or will be well learned from the practices of the disclosure.

BRIEF DESCRIPTION OF THE DRAWINGS

The foregoing and/or additional aspects and advantages of the disclosure become apparent and easily comprehensible from the description of the embodiments with reference to the following accompanying drawings, in which.

REFERENCE NUMERALS

Figure 1:
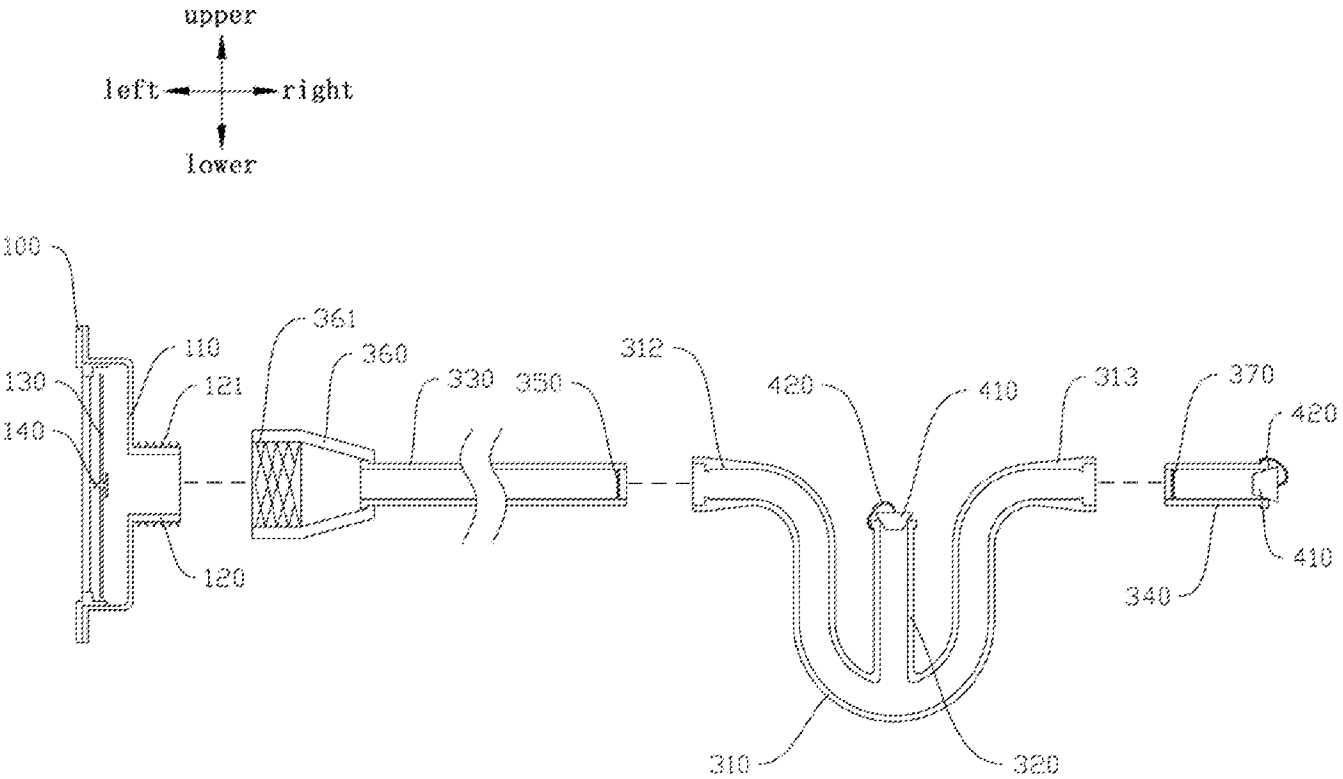
FIG. 1 is a schematic structural diagram according to an embodiment of the disclosure.

100 mask body
110 breather valve
120 air inlet and outlet tube
121 first external thread
130 filter sheet
140 positioning post
200 elastic ear loop
310 U-shaped tube
311 scale
312 third straight tube
313 fourth straight tube
320 disinfectant replenishing tube
330 first horizontal straight tube
340 second horizontal straight tube
350 first filter mesh
360 large-diameter tube
361 first internal thread
370 second filter mesh
410 piston
420 string

DETAILED DESCRIPTION

Specific embodiments of the disclosure will be described in detail in this section, and the preferred embodiments of the disclosure are shown in the accompanying drawings. The accompanying drawings are used for supplementing the written description graphically so that each technical feature and the overall technical solution of the disclosure can be understood intuitively and visually. However, it should not be regarded as limiting the protection scope of the disclosure.

In the description of the disclosure, it should be understood that, the orientation or position relation indicated by the terms "upper", "lower", "front", "rear", "left", "right" or the like is an orientation or position relation shown in the accompanying drawings, merely for describing the disclosure and simplifying the description rather than indicating or implying that the specified device or element must have a particular orientation or be constructed and operated in a particular orientation. Therefore, it should not be interpreted as limitations to the disclosure.

In the description of the disclosure, the terms "first" and "second" are merely used for distinguishing the technical features, rather than implying or indicating relative importance or implicitly indicating the number of the involved technical features or the precedence relationship between the involved technical features.

In the description of the disclosure, unless otherwise explicitly defined, the terms "arrange", "mount", "connect" or the like shall be interpreted in a broad sense. The specific meanings of these terms in the disclosure can be reasonably determined in combination with the specific contents of the technical solutions by those skilled in the art.

Referring to FIG. 1 to FIG. 5, a waterseal virus-killing mask according to an embodiment of the disclosure includes a mask body 100, a liquid virus-killing assembly, and two elastic ear loops 200. A breather valve 110 is disposed on an outer surface of the mask body 100. The two elastic ear loops 200 are disposed on two sides of the mask body 100, respectively. The liquid virus-killing assembly includes a U-shaped tube 310 within which disinfectant is provided. A disinfectant replenishing tube 320 is vertically disposed at an upper end in the middle of the U-shaped tube 310. A first horizontal straight tube 330 and a second horizontal straight tube 340 are separately disposed at two ends of the U-shaped tube 310. The first horizontal straight tube 330 includes a left end in communication with a port of the breather valve 110 and a right end within which a first filter mesh 350 used to separate water and air is disposed. Compared with the prior art, in the embodiment of the disclosure, by disposing the liquid virus-killing assembly at the port of the breather valve 110, as a wearer inhales air, novel coronaviruses in external air entering the U-shaped tube 310 through the second horizontal straight tube 340 will be killed by the disinfectant when the external air flows through the U-shaped tube 310. The disinfected air then passes through the first filter mesh 350 to have the disinfectant contained in the air filtered, so that the air eventually inhaled by the wearer is disinfected clean air without disinfectant, thereby effectively protecting the physical health of a wearer. As the wearer exhales air, the exhaled air enters the U-shaped tube 310 through the first horizontal straight tube 330 to be disinfected by the disinfectant, thereby ensuring that the exhaled air contains no virus. Particularly, when a person infected with NCP wears the mask, it can be ensured that air exhaled by the person contains no virus, thereby reducing the risk of cross infection. The embodiment of the disclosure can achieve effective virus-killing and adequate protection. The mask can be repeatedly used and has long service life, thereby resolving the problem that a large number of conventional disposable masks are used. Moreover, with the provision of the disinfectant replenishing tube 320, when the disinfectant in the U-shaped tube 310 is reduced to a particular amount after a period time of use, the U-shaped tube 310 can be replenished with the disinfectant through the disinfectant replenishing tube 320. As shown in FIG. 1, specifically, a piston 410 used for sealing is separately disposed at an opening of the disinfectant replenishing tube 320 and an opening at a right end of the second horizontal straight tube 340. The two pistons 410 are separately fixed on the disinfectant replenishing tube 320 and the second horizontal straight tube 340 by a string 420. By disposing the piston 410 at the opening of the disinfectant replenishing tube 320, the opening of the disinfectant replenishing tube 320 can be sealed to prevent impurities or the like from entering the U-shaped tube 310 through the opening of the disinfectant replenishing tube 320 to protect the disinfectant from pollution, thereby ensuring that the disinfectant thoroughly kills viruses, and the disinfectant can be prevented from leaking through the opening of the disinfectant replenishing tube 320. By disposing the piston 410 at the opening at the right end of the second horizontal straight tube 340, when the mask is not in use, the piston 410 can be used to seal the opening at the right end of the second horizontal straight tube 340, to prevent volatilization of the disinfectant through the opening of the second horizontal straight tube 340 to cause a waste.

In some embodiments of the disclosure, the disinfectant is 75% alcohol, a strong acid solution or a strong alkaline liquid. Here, the disinfectant is preferably 75% alcohol which can effectively kill novel coronaviruses and has a low price, thereby reducing purchasing costs.

Figure 4:
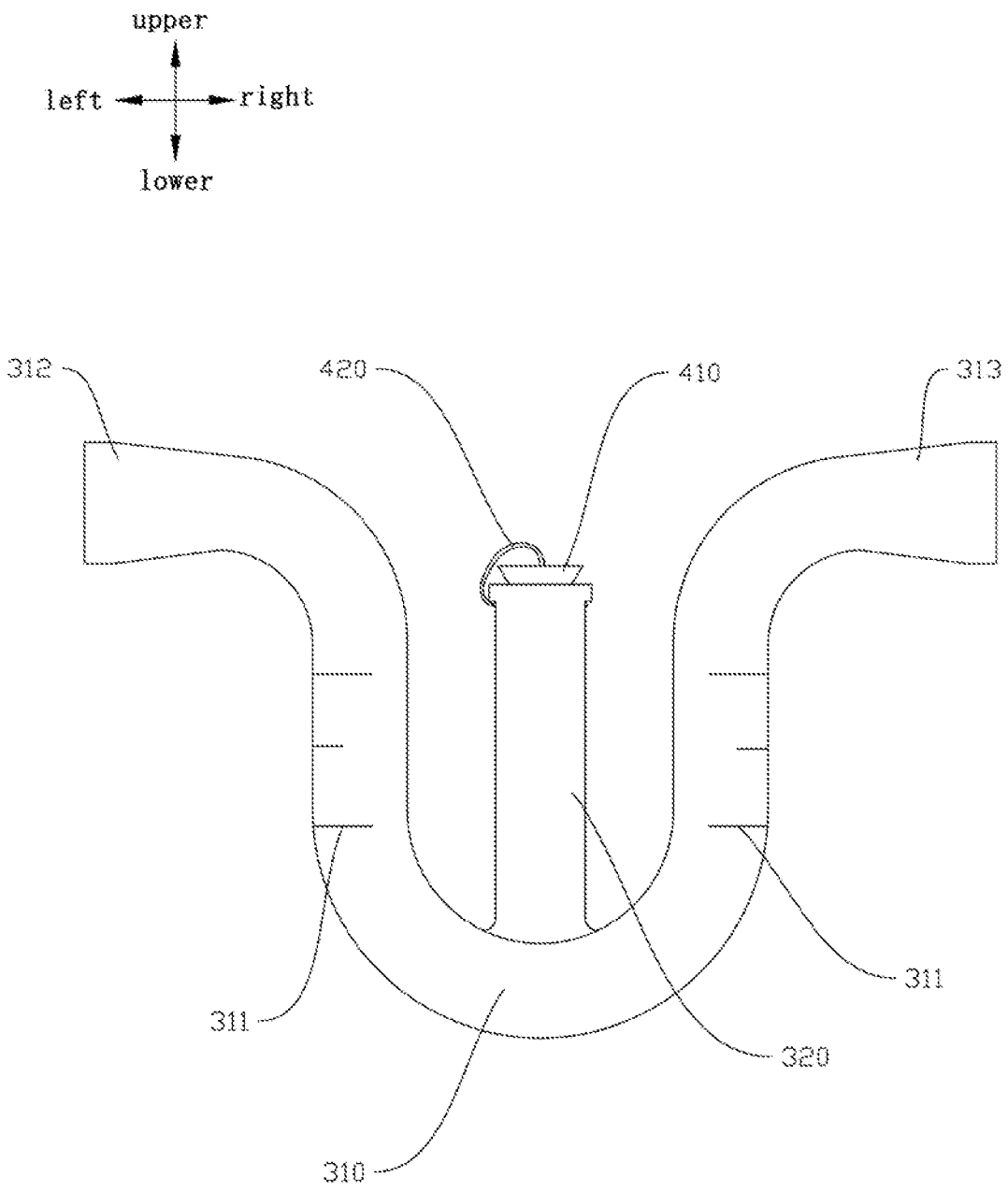
FIG. 4 is a schematic structural diagram of a U-shaped tube according to an embodiment of the disclosure.
Figure 5:
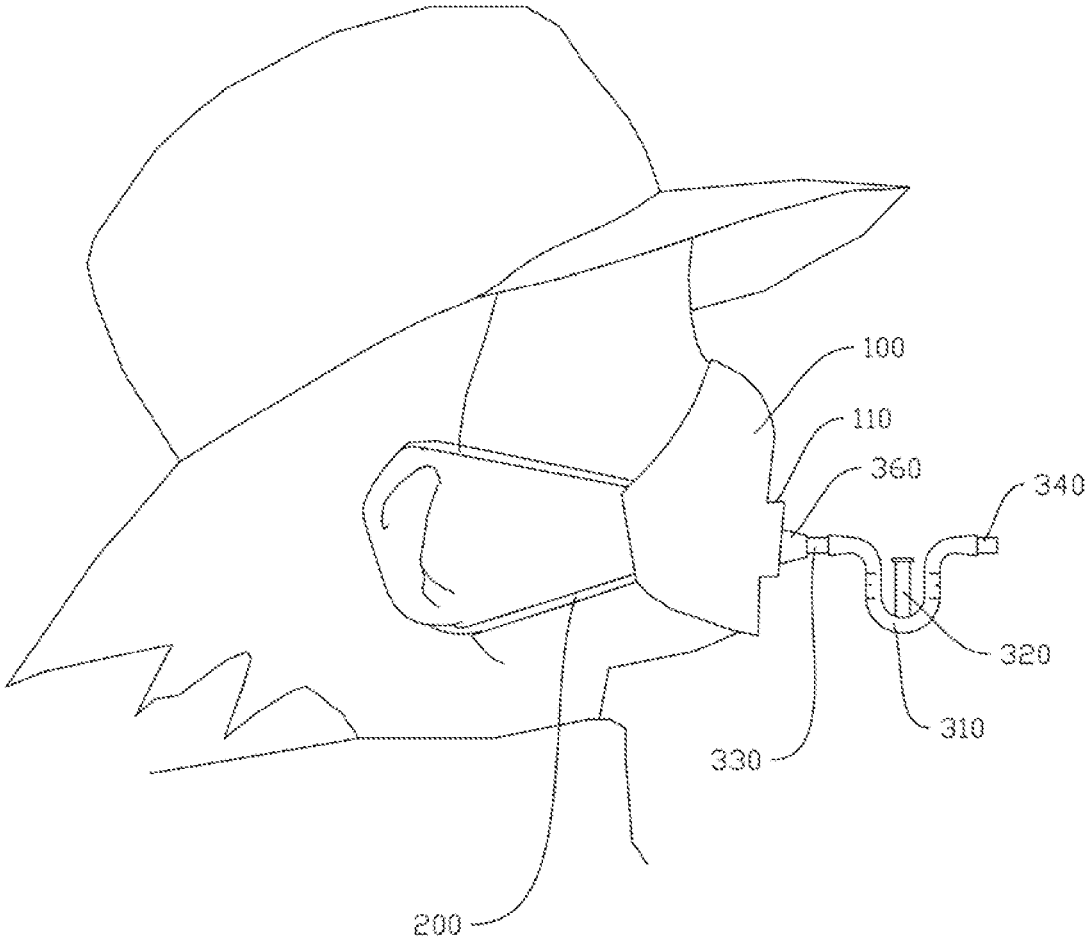
FIG. 5 is a schematic diagram of a use status according to an embodiment of the disclosure.

As shown in FIG. 4, in some embodiments of the disclosure, the U-shaped tube 310 is a transparent tube provided with a scale 311 for observing the remainder of the disinfectant. With such an arrangement, a wearer can conveniently observe the color and the remainder of the disinfectant in real time, so that the wearer can replace the disinfectant or replenish the U-shaped tube 310 with the disinfectant in time. Specifically, the U-shaped tube 310 is provided with three scales 311, which represent a maximum amount, an intermediate amount, and a minimum amount of the disinfectant from top to bottom, respectively, so that the wearer can observe and replenish a suitable amount of the disinfectant.

Figure 2:
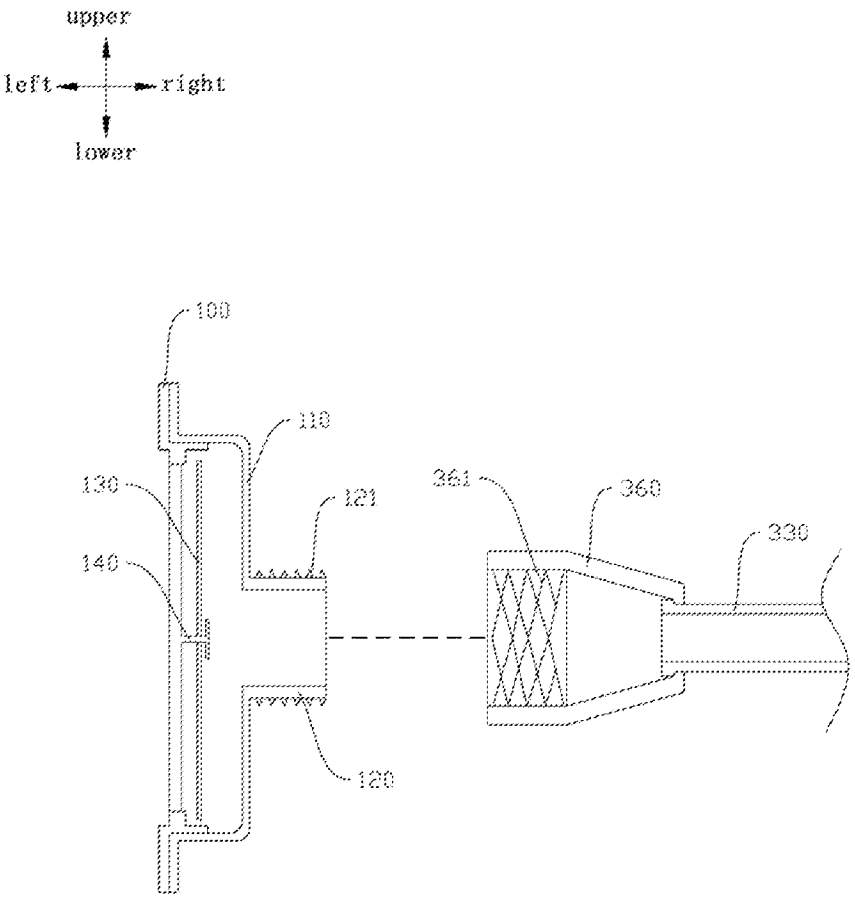
FIG. 2 is a schematic assembled diagram of a mask body and a first horizontal straight tube according to an embodiment of the disclosure.
Figure 3:
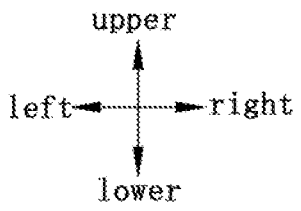
FIG. 3 is a schematic structural diagram of a second horizontal straight tube according to an embodiment of the disclosure.
Figure 3:
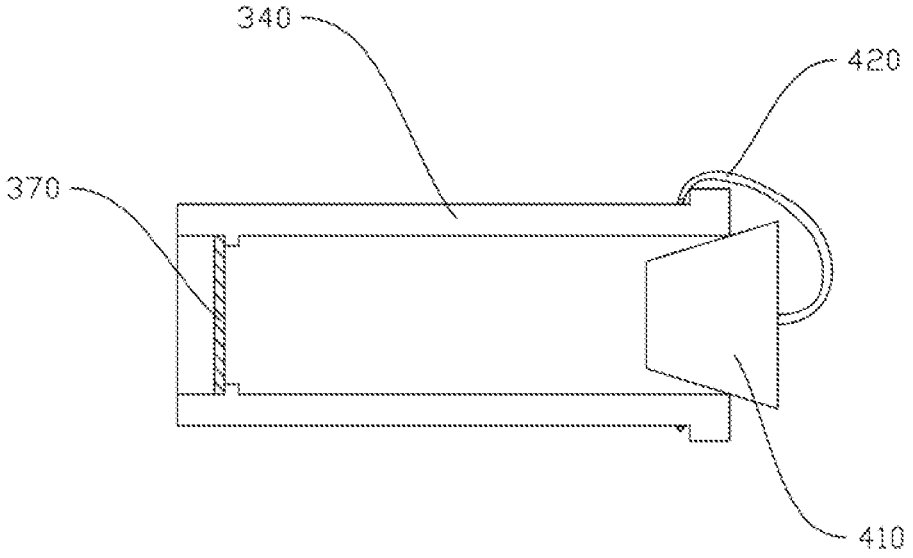

As shown in FIG. 1 and FIG. 2, in some embodiments of the disclosure, an air inlet and outlet tube 120 is disposed at the opening of the breather valve 110, a first external thread 121 is disposed at an end portion of the air inlet and outlet tube 120 away from the breather valve 110, and a first internal thread 361 matching the first external thread 121 is disposed in a left end portion of the first horizontal straight tube 330. The first external thread 121 is threaded with the first internal thread 361, so that the air inlet and outlet tube 120 can be stably connected to the first horizontal straight tube 330. Therefore, during use, the first horizontal straight tube 330 is prevented from being disconnected from the air inlet and outlet tube 120, thus ensuring the effect of protection, and the assembly and detachment are facilitated for replacement and maintenance. Specifically, a large-diameter tube 360 is disposed at the left end portion of the first horizontal straight tube 330, and the first internal thread 361 is disposed in the large-diameter tube 360.

In some embodiments of the disclosure, a left end of the U-shaped tube 310 bends outward by 90° to form a third straight tube 312, the first horizontal straight tube 330 is detachably connected to the third straight tube 312, and the first filter mesh 350 is disposed at a connection between the first horizontal straight tube 330 and the third straight tube 312. With such an arrangement, after use for a period time, when damage occurs in the first filter mesh 350, the first horizontal straight tube 330 and the third straight tube 312 can be detached and separated, to allow the first filter mesh 350 to be detached for replacement.

In the embodiment of the disclosure, a second external thread is disposed on an outer surface of the right end of the first horizontal straight tube 330, and a second internal thread matching the second external thread is disposed in a left end portion of the third straight tube 312. The second external thread is threaded with the second internal thread, so that the first horizontal straight tube 330 is stably connected to the third straight tube 312. Therefore, during use, the first horizontal straight tube 330 is prevented from being disconnected from the third straight tube 312, thereby ensuring the effect of protection, and it is convenient to detach the first filter mesh 350 for replacement.

In some embodiments of the disclosure, a right end portion of the first horizontal straight tube 330 is inserted in a left end of the third straight tube 312, a sealing sleeve is sleeved over the right end portion of the first horizontal straight tube 330, and the sealing sleeve enables the first horizontal straight tube 330 to be in interference fit in the third straight tube 312. The right end portion of the first horizontal straight tube 330 is in interference fit in an inner hole in the left end portion of the third straight tube 312, so that the first horizontal straight tube 330 and the third straight tube 312 are stably connected and generally will not become loose. When the first horizontal straight tube 330 and the third straight tube 312 need to be separated, it is only necessary to forcefully pull out the first horizontal straight tube 330.

In some embodiments of the disclosure, a second filter mesh 370 used to separate water and air is disposed at a left end of the second horizontal straight tube 340. With such an arrangement, in one aspect, waste due to the automatic volatilization of the disinfectant in the U-shaped tube 310 can be avoided, and in another aspect, it can be avoided that the disinfectant is exhaled outside with air during exhalation, thereby preventing the disinfectant from being consumed rapidly.

In some embodiments of the disclosure, a right end of the U-shaped tube 310 bends outward by 90° to form a fourth straight tube 313, the left end of the second horizontal straight tube 340 is threaded with a right end of the fourth straight tube 313, and the second filter mesh 370 is disposed at a connection between the second horizontal straight tube 340 and the fourth straight tube 313. With such an arrangement, the second horizontal straight tube 340 is stably connected to the fourth straight tube 313. Therefore, during use, the second horizontal straight tube 340 is prevented from being disconnected from the fourth straight tube 313, so as to ensure normal use. After use for a period of time, when damage occurs in the second filter mesh 370, the second horizontal straight tube 340 and the fourth straight tube 313 can be detached and separated, to allow the second filter mesh 370 to be detached for replacement. Specifically, a third external thread is disposed on an outer surface of a left end of the second horizontal straight tube 340. A third internal thread matching the third external thread is disposed in a right end portion of the fourth straight tube 313. Certainly, according to an actual requirement, the left end of the fourth straight tube 313 can be inserted in the right end of the second horizontal straight tube 340 in interference fit to achieve detachable connection.

As shown in FIG. 2, in some embodiments of the disclosure, a filter sheet 130 is disposed between the outer surface and an inner surface of the mask body 100, a positioning post 140 is disposed on a right side of the inner surface of the mask body 100, and the filter sheet 130 is connected to the positioning post 140. The positioning post 140 enables the filter sheet 130 to be accurately and reliably connected to the mask body 100, thereby ensuring that disinfected clean air with disinfectant removed undergoes secondary filtering by the filter sheet 130, thereby further improving the effect of protection of the embodiment of the disclosure.

Further, the mask body 100 uses a K95 protective mask with a breather valve 110. The adequate filtering effect of the K95 protective mask with the breather valve 110 in combination with the virus-killing effect of the disinfectant in the U-shaped tube 310 provides the embodiment of the disclosure with a better protection effect, and the protection effect lasts longer, so that the consumption of commercially available masks with a breather valve 110 is reduced, and the supply pressure of existing masks is reduced.

In some embodiments of the disclosure, a disinfectant discharge tube is vertically disposed at a lower end in the middle of the U-shaped tube 310, and a valve for controlling the disinfectant discharge tube to be opened or closed is disposed on the disinfectant discharge tube. With such an arrangement, when the concentration or quality of the disinfectant in the U-shaped tube 310 is not adequate to kill viruses, the valve can be opened to completely discharge the disinfectant in the disinfectant discharge tube, and new disinfectant is then replenished through the disinfectant replenishing tube 320.

The foregoing description merely shows the preferred embodiments of the disclosure and is not intended to limit the disclosure. Various alterations and changes can be made to the disclosure by those skilled in the art. Any modifications, equivalent replacements and improvements made without departing from the concept and principle of the disclosure shall fall into the protection scope of the disclosure.

We claim:

1. A waterseal virus-killing mask, comprising:

a mask body with a breather valve disposed on an outer surface of the mask body;

two elastic ear loops disposed on two sides of the mask body, respectively; and a liquid virus-killing assembly, comprising:

a U-shaped tube within which disinfectant is provided, a disinfectant replenishing tube vertically disposed at an upper end in the middle of the U-shaped tube, a first horizontal straight tube disposed at one end of the U-shaped tube, and including a left end in communication with a port of the breather valve and a right end within which a first filter mesh used to separate water and air is disposed, and a second horizontal straight tube disposed at the other end of the U-shaped tube.

2. The waterseal virus-killing mask of claim 1, wherein the U-shaped tube is a transparent tube provided with a scale for observing the remainder of the disinfectant.

3. The waterseal virus-killing mask of claim 1, wherein an air inlet and outlet tube is disposed at the port of the breather valve, a first external thread is disposed at an end portion of the air inlet and outlet tube away from the breather valve, and a first internal thread matching the first external thread is disposed in a left end portion of the first horizontal straight tube.

4. The waterseal virus-killing mask of claim 1, wherein a third straight tube is formed by bending outward a left end of the U-shaped tube by 90°, the first horizontal straight tube is detachably connected to the third straight tube, and the first filter mesh is disposed at a connection between the first horizontal straight tube and the third straight tube.

5. The waterseal virus-killing mask of claim 4, wherein the first horizontal straight tube is provided, on an outer surface of the right end of the first horizontal straight tube, with a second external thread which is matched with a second internal thread disposed in a left end portion of the third straight tube.

6. The waterseal virus-killing mask of claim 4, wherein a right end portion of the first horizontal straight tube is inserted in a left end of the third straight tube, a sealing sleeve is sleeved over the right end portion of the first horizontal straight tube, and the sealing sleeve enables the first horizontal straight tube to be in interference fit in the third straight tube.

7. The waterseal virus-killing mask of claim 1, wherein a second filter mesh used to separate water and air is disposed within a left end of the second horizontal straight tube.

8. The waterseal virus-killing mask of claim 7, wherein a fourth straight tube is formed by bending outward a right end of the U-shaped tube by 90°, the left end of the second horizontal straight tube is threaded with a right end of the fourth straight tube, and the second filter mesh is disposed at a connection between the second horizontal straight tube and the fourth straight tube.

9. The waterseal virus-killing mask of claim 1, wherein a filter sheet is disposed between the outer surface and an inner surface of the mask body, a positioning post is disposed on a right side of the inner surface of the mask body, and the filter sheet is connected to the positioning post.

* * * * *